US012768009B2

(12) United States Patent
Lipke et al.

(10) Patent No.: US 12,768,009 B2
(45) Date of Patent: Oct. 20, 2026

(54) MANUFACTURE OF ALLOYS WITH CONTROLLED CHEMICAL COMPOSITIONS VIA CHEMICAL VAPOR TRANSPORT ANNEALING

(71) Applicant: The Curators of the University of Missouri, Columbia, MO (US)

(72) Inventors: David W. Lipke, Rolla, MO (US); Andrew S. King, Canisteo, NY (US); Ryan D. Dempsey, Rolla, MO (US)

(73) Assignee: The Curators of the University of Missouri, Columbia, MO (US)

( * ) Notice: Subject to any disclaimer, the term of this patent is extended or adjusted under 35 U.S.C. 154(b) by 312 days.

(21) Appl. No.: 17/952,995

(22) Filed: Sep. 26, 2022

(65) Prior Publication Data

US 2023/0096442 A1 Mar. 30, 2023

Related U.S. Application Data

(60) Provisional application No. 63/281,858, filed on Nov. 22, 2021, provisional application No. 63/248,715, filed on Sep. 27, 2021.

(51) Int. Cl.
*C22C 1/08* (2006.01)
*C22C 19/00* (2006.01)

(52) U.S. Cl.
CPC ..... *C22C 1/08* (2013.01); *C22C 19/007* (2013.01)

(58) Field of Classification Search
CPC ..... C22C 1/08
See application file for complete search history.

(56) References Cited

U.S. PATENT DOCUMENTS 1,246,571 A * 11/1917 Eldridge ..... C22C 9/04 420/491
3,764,373 A * 10/1973 Speirs ..... C23C 10/34 415/196
5,364,659 A 11/1994 Rapp et al.
2018/0229332 A1 8/2018 Tsai et al.

OTHER PUBLICATIONS

Andrew King, Thermodynamically Controlled Replication of Nickel Foams Into Near-Equiatomic Nickel-Titanium Intermetallic Foams, thesis made available on Sep. 27, 2021, https://aura.alfred.edu/items/3fc6849d-2bb0-4b13-a89f-76defaa4fffb (Year: 2019).*
Achuthankutty, Ajith. Deposition Kinetics of Titanium and Zirconium Diffusion Coatings on Nickel Microwires via Pack Cementation. MS thesis. University of Cincinnati, 2020.*

(Continued)

*Primary Examiner* — Christopher S Kessler
(74) *Attorney, Agent, or Firm* — Stinson LLP

(57) ABSTRACT

A method for manufacturing a metal alloy component. The method comprises heating a shaped metal component and an alloying element source of vapor-phase transportable alloying element species in a reactor in the presence of a vapor-phase transport agent, wherein the heating is conducted under conditions which cause the vapor-phase transportable alloying element species to diffuse into the shaped metal component; and forming a metal alloy component alloyed with element species from the alloying element source.

13 Claims, 11 Drawing Sheets

(56) References Cited

OTHER PUBLICATIONS

Gibson, L.J., et al., "Cellular Solids: Structure and Properties," Cambridge University Press, 1997.
Nickl, J.J., et al., "Untersuchungen über Den Isothermen Chemischen Transport," (1973) J. Less-Common Met., vol. 32, pp. 243-273, English Abstract only.
Ashby, M.F., et al., "Metal Foams: A Design Guide," (2000), Butterworth-Heinemann, pp. 1-263.
ASTM F2004-17, Standard Test Method for Transformation Temperature of Nickel-Titanium Alloys by Thermal Analysis, ASTM International, West Conshohocken, PA, 2017, Scope Page only.
Atwater, M.A., et al. "Solid State Porous Metal Production: A Review of the Capabilities, Characteristics, and Challenges," (2018), Adv. Eng. Mater., vol. 20, 1700766, Abstract only.
Bale, C.W., "FactSage Thermochemical Software and Databases, 2010-2016," (2016), Calphad, vol. 54, pp. 35-53.
Bansiddhi, A., "Porous NiTi for Bone Implants: A Review," (2008), Acta Biomater, vol. 4, pp. 773-782.
Bansiddhi, A., et al. "Shape-Memory NiTi Foams Produced by Solid-State Replication with NaF," (2007), Intermetallics, vol. 15, pp. 1612-1622.
Bansiddhi, A., et al., "Shape-Memory NiTi Foams Produced by Replication of NaCl Space-Holders," (2008), Acta Biomater., vol. 4, No. 6, pp. 1996-2007.
Bastin, G.F., et al., "Diffusion in the Titanium-Nickel System: II. Calculations of Chemical and Intrinsic Diffusion Coefficients," (1974), Metall. Trans., vol. 5, pp. 1827-1831, Abstract only.
Bauer, J., et al., "Tensegrity Metamaterials: Toward Failure-Resistant Engineering Systems through Delocalized Deformation," (2021), Adv. Mater., vol. 33, 2005647, pp. 1-9.
Behr, G., et al., "Single Crystal Growth of Non-Stoichiometric β—FeSi2 by Chemical Transport Reaction," (2001), Thin Solid Films, vol. 381, Issue 2, pp. 276-281, Abstract only.
Binnewies, M., et al., "Chemical Vapor Transport Reactions—A Historical Review," (2013), Zeitschrift für anorganische und allgemeine Chemie, 639, pp. 219-229, Abstract only.
Binnewies, M. et al., "Chemical Vapor Transport Reactions—Arguments for Choosing a Suitable Transport Agent," (2017), Z. Anorg. Allg. Chem., vol. 643, pp. 1295-1311.
Bram, M., et al., "Mechanical Properties of Highly Porous NiTi Alloys," (2011), J. Mater. Eng. Perform., vol. 20, pp. 522-528, Abstract only.
Campbell, I.E, et al., "The Preparation and Properties of Pure Titanium", (1948), Journal of The Electrochemical Society, vol. 93, No. 6., pp. 271, Abstract only.
Chen, G., et al., "Porous NiTi Alloys Produced by Press-and-Sinter from Ni/Ti and Ni/TiH2 Mixtures," (2013), Mater. Sci. Eng. vol. 582, pp. 117-125, Abstract only.
Dadbakhsh, S., et al. "Laser Additive Manufacturing of Bulk and Porous Shape-Memory NiTi Alloys: From Processes to Potential Biomedical Applications" (2016), MRS Bull., vol. 41, pp. 765-774.
Elahinia, M., et al. "Fabrication of NiTi Through Additive Manufacturing: A Review," (2016), Prog. in Mater. Sci., vol. 33, pp. 1-70.
Fleming, J.G., et al., "Control of the Surface Composition of Isothermal Vapor Phase Epitaxial Mercury Cadmium Telluride," (1987), J. Vac. Sci. Technol. A., vol. 5, pp. 3383-3385.
Fleming, J.G., et al., "Isothermal Vapor Phase Epitaxy of Mercury Cadmium Telluride," (1987), J. Crys. Growth, vol. 32, pp. 621-627.
Frenzel, J., et al., "On the Effect of Alloy Composition on Martensite Start Temperatures and Latent Heats in Ni—Ti-Based Shape Memory Alloys," (2015), Acta Materials, vol. 90, pp. 213-231, Abstract only.
Fuentes et al., "Phase Change Behavior of Nitinol Shape Memory Alloys—Influence of Heat and Thermomechanical Treatements," (2002), Adv. Eng. Mater. vol. 4, No. 7, pp. 437-450.
Gotman, I, "Fabrication of Load-Bearing NiTl Scaffolds for Bone Ingrowth by Ni Foam Conversion," (2010) vol. 12, No. 7., pp. 320-325.
Gotman, I. et al. "Mesenchymal Stem Cell Proliferation and Differentiation on Load-Bearing Trabecular Nitinol Scaffolds," (2013), vol. 9, pp. 8440-8448.
Grummon, D.S., et al., "Low-Density Open-Cell Foams in the NiTi System," (2003), Appl. Phys. Lett., vol. 82, pp. 2727-2729.
Humbeeck, J. V., "Shape Memory Alloys: A Material and a Technology," (2001), Adv Eng. Mater, vol. 3 pp. 837-850, Abstract only.
Itin, V.I. et al., "Mechanical Properties and Shape Memory of Porous Nitinol," (1994), Materials Characterization, vol. 32, pp. 179-187, Abstract only.
Jani, J.M, et al., "A Review of Shape Memory Alloy Research, Applications and Opportunities," (2014), Materials & Design, vol. 56, pp. 1078-1113.
Jardine, A.P., "Shock Mitigation in Open-Celled TiNi Foams," (2018), Shape Mem. and Superelasticity, vol. 4, pp. 294-308.
King, A., "Thermodynamically Controlled Replication of Nickel Foams into Near-Equiatomic Nickel-Titanium Intermetallic Foams, "Thesis submitted to Alfred University, (2019), Master of Science in Materials Science and Engineering, 60 pages.
Kosyakov, A.V., et al., "Chemical Vapor Transport: A Viable Approach to Controlling the Composition of Intermetallic Phases Promising for Catalyst Engineering," (2007), Inorganic Materials, vol. 43, No. 11, pp. 1199-1205.
Li, B-Y, et al., "Transformation Behavior of Sintered Porous NiTi Alloys," (1999), Metall. and Mater. Trans., vol. 30, pp. 2753-2756.
Lipke, D.W, "Research Activities and Collaborative Opportunities—Lipke Research Group" Dept. of Materials Science and Engineering Missouri University of Science and Technology, (2013) pp. 1-19.
McCormick, P.G., et al. "Thermodynamic Analysis of the Martensitic Transformation in NiTi—II. Effect of Transformation Cycling" (1994), Acta Metall. Mater. vol. 42, pp. 2407-2413.
Mwangi, J.W., et al., "Nitinol Manufacturing and Micromachining: A Review of Processes and Their Suitability in Processing Medical-Grade Nitinol," (2019), J. Manuf. Process., vol. 38, pp. 355-369, Abstract only.
Olurin, O.B., et al., "Strength and Ductility of As-Plated and Sintered CVD Nickel Foams," (2003), Comp. Sci. and Tech., vol. 63, pp. 2317-2329, Abstract only.
Paserin, V., et al., "CVD Technique for Inco Nickel Foam Production," (2004), Adv. Eng. Mater., vol. 6, pp. 454-459.
Paz y Puente, A.E., et al., "Shape-Memory Characterization of NiTi Microtubes Fabricated Through Interdiffusion of Ti- Coated Ni wires," (2018), Acta Mater., vol. 156, pp. 1-26, 36 pages.
Paz y Puente, A.E., et al., "Synthesis of NiTi Microtubes via the Kirkendall Effect During Interdiffusion of Ti-Coated Ni Wires," (2018), Intermetallics, vol. 92, pp. 42-48.
Pelton, A.R., et al., "Effects of Thermal Cycling on Microstructure and Properties in Nitinol," (2012) Material Science and Eng., vol. 532, pp. 130-138.
Rajagopalan, S., et al., "Elastic Modulus of Shape-Memory NiTi From In Situ Neutron Diffraction During Macroscopic Loading, Instrumented Indentation, and Extensometry," (2005), Appl. Phys. Lett., vol. 86, pp. 081901-081901-3.
Schaedler, T.A., et al., "Ultralight Metallic Microlattices," (2011), Science, vol. 334, pp. 962-965.
Schafer, H., Der Chemische Transport und die "Löslichkeit des Bodenkörpers in der Gasphase," (1973), Zeitschrift für anorganische und allgemeine Chemie, vol. 400, pp. 242-252, English Abstract only.
Shaw, J.A., et al. "Superelastic NiTi Honeycombs: Fabrication and Experiments," (2007), Smart Mater. and Struct., vol. 16, pp. S170-S178.
Speirs, M., et al., "On the Transformation Behavior of NiTi Shape-Memory Alloy Produced by SLM," (2016), Shap. Mem. and Superelasticity, vol. 2, pp. 310-316.
Surjadi, A. et al. "Mechanical Metamaterials and Their Engineering Application," (2019), Adv. Eng. Mater., vol. 21, pp. 1800864-1800864, 37 pages.
Taylor, S.L, et al. "Iron and Nickel Cellular Structures by Sintering of 3D-Printed Oxide or Metallic Particle Inks", (2017) Adv. Eng. Mater., vol. 19, 1600365, pp. 1-8.

(56) References Cited

OTHER PUBLICATIONS

Wei, Z.G., et al., "Shape-Memory Materials and Hybrid Composites for Smart Systems: Part I Shape Memory Materials," (1998), J. Mater Sci., vol. 33, pp. 3743-3762.
Zavrazhnov, A.Y., et al., "Chemical Transport Reactions as a New Variant of the Phase Composition Control," (2003), J. Phase Equil., vol. 24, pp. 330-339.
Zavrazhnov, A.Y., et al., "Chemical Vapor Transport as a Means of Controlling the Composition of Condensed Phases," (2004), Inorg. Mater., vol. 40 (Suppl 2), pp. S101-S127.
Gruters et al, "Influence of thermodynamic activities of different masteralloys in pack powder mixtures to produce low activity aluminide coatings on TiAl alloys", Intermetallics 60, 2015, 19-27.
Nciri et al, "Theoretical and Experimental Study of the Aluminization of Iron and Steel in the Pack and in the Gas Phase", Thin Solid Films, 139, 1986, 311-324.

* cited by examiner

MANUFACTURE OF ALLOYS WITH CONTROLLED CHEMICAL COMPOSITIONS VIA CHEMICAL VAPOR TRANSPORT ANNEALING

CROSS-REFERENCE TO RELATED APPLICATIONS

This application claims priority from U.S. Provisional Patent Application No. 63/248,715, filed Sep. 27, 2021, and U.S. Provisional Patent Application No. 63/281,858, filed Nov. 22, 2021, the entire disclosures of which are incorporated herein by reference.

FIELD

The present disclosure relates to a method for precisely imparting a specific composition to a shaped metal alloy component.

BACKGROUND

With some alloys, the behavior of the alloy is sensitively tied to its composition. For example, nickel-titanium alloys must have a specific composition in order to exhibit a specific shape memory effect.

One way to manufacture a component to have a precise composition is to alloy raw material to form the composition, and then form the component out of the composition by traditional methods such as powder metallurgy manufacturing, forging, stamping, or casting. With these traditional methods of forming, a precise composition can be achieved by carefully forming the raw material to have the precise composition.

With certain manufacturing methods, however, the composition of the material changes during manufacturing. For example, US Patent Publication 2018/0229332 for FOIL-BASED ADDITIVE MANUFACTURING SYSTEM AND METHOD describes a process in which laser energy is used to attach sequential alloy foil layers to additively manufacture a final shape. In such a process, the application of laser energy can change the composition of the component if the alloy has different components which volatilize at different rates in reaction to the application of laser energy, such as Ni and Ti. In such situations it can therefore be desirable to impart a precise alloy composition after manufacture of a specifically shaped component. One method to impart changes in composition to a manufactured component without changing its shape is to employ a secondary heat treatment with the objective to diffuse alloying elements into or out of the shaped component until the desired composition is reached.

Prior methods to control chemical composition of a finished component utilized vapor-phase transport to diffuse elements into or out of the component from or toward a pure single-phase metal or metallic compound as a source or sink of alloying element, respectively. For example, pure Ti has been used as a source of Ti to drive Ti into a Ni—Ti component to move the overall composition towards one that exhibits shape memory behavior. In particular, the amount of Ti transported to the Ni—Ti component has been controlled by empirical optimization of the diffusion heat treatment time. Since the Ti source was a single phase with chemical potential for the Ti component exceeding that of the Ni—Ti composition needed to produce the desired shape memory behavior, excessive heat treatment times could lead to excess Ti transport and uptake into the shaped component.

Over-titanization results in the formation of undesirable compositions and phases, such as $Ti_2Ni$, which does not exhibit shape memory behavior. As a result, process kinetics had to be optimized on a component-by-component basis to prevent over-titanization and precisely control chemical composition of the shaped component.

SUMMARY

Aspects of the present disclosure overcome the limitations of the prior art by providing a more reliable and repeatable way to impart a precise composition to a metal alloy component.

One embodiment of the present disclosure is directed to a method for manufacturing a metal alloy component. The method comprises heating a shaped metal component and an alloying element source of vapor-phase transportable alloying element species in a reactor in the presence of a vapor-phase transport agent, wherein the heating is conducted under conditions which cause the vapor-phase transportable alloying element species to diffuse into the shaped metal component; and forming a metal alloy component alloyed with element species from the alloying element source.

Other embodiments of the present disclosure are directed to a method for manufacturing a metal alloy component. The method comprises heating a shaped metal component and an alloying element sink for vapor-phase transportable alloying element species in a reactor under conditions which cause the vapor-phase transportable alloying element species to diffuse from the shaped metal component to the sink to thereby form a metal alloy component of a predetermined composition.

Other objects and features will be in part apparent and in part pointed out hereinafter.

BRIEF DESCRIPTION OF THE DRAWINGS

FIG. 3C shows a representative EDS linescan across the dashed chord shown in FIG. 3B.

DETAILED DESCRIPTION

Figure 1:
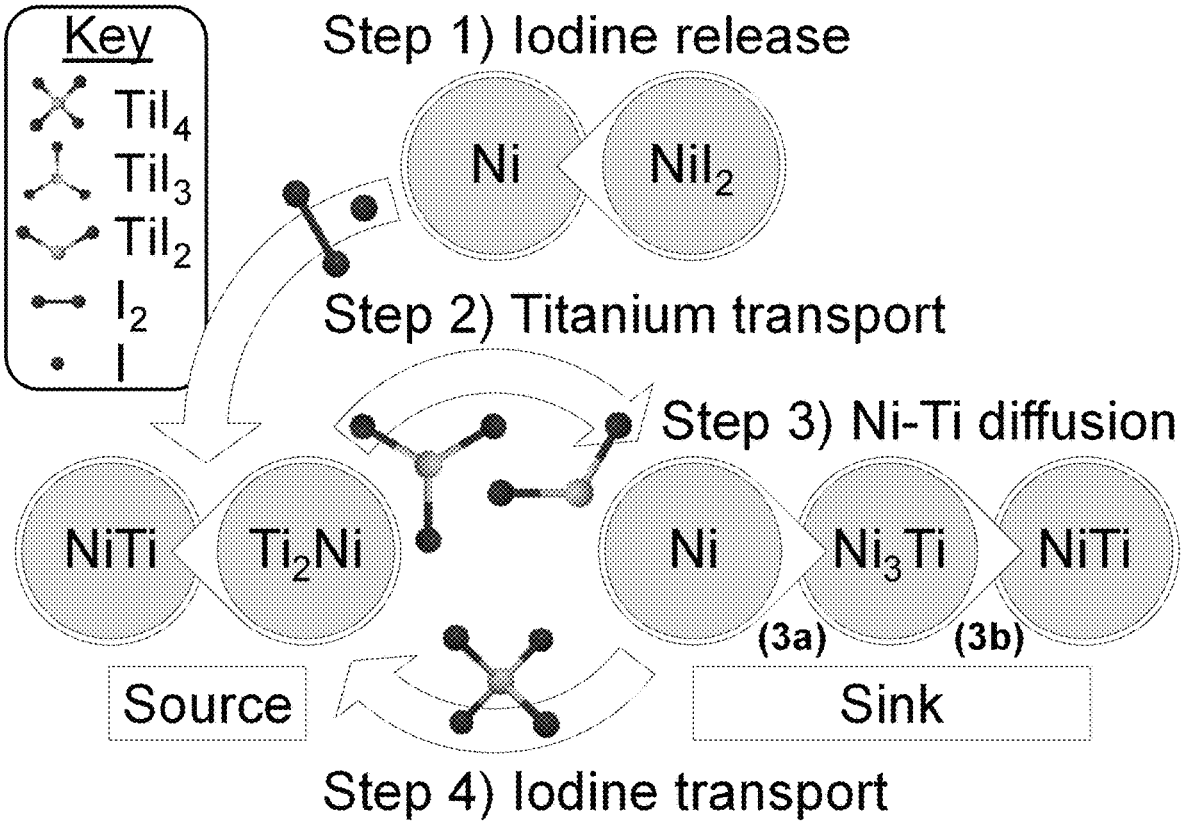
FIG. 1 illustrates a reaction scheme according to an embodiment.

Shape memory alloys (SMAs) feature distinctive diffusionless phase transformations that give rise to useful functionalities that have resulted in wide-scale commercial applications across aerospace, automotive, biomedical, robotics, and other technological fields. For example, SMAs may be useful to generate force/motion or to store/dissipate deformation energy. In certain applications, SMAs may be based on near-equiatomic NiTi. Components for a SMA may contain complex architectures (e.g., ranging from honeycombs to cellular structures) or be selected for use in lightweight systems, to match with the stiffness of adjoined materials, or to intensify the overall deformation response. However, these complex architectures and resulting thermal-mechanical behaviors that make SMAs desirable also make their manufacture notoriously challenging.

NiTi-based SMAs exhibit acute sensitivity to the chemistry and microstructure that can be significantly impacted by the thermal-mechanical histories of processing and use. Strategies have been previously explored to manufacture complex-shaped NiTi SMA components, including various methods for metal joining and metal additive manufacturing. However, the high temperature processing techniques previously employed have been found to encounter difficulty in maintaining precise control over the chemistry of the material. For example, selective laser melting and fusion welding techniques can cause NiTi in localized regions to greatly exceed its melting point (1310° C.), resulting in incongruent volatilization with preferential loss of nickel. The ensuing compositional shift leads to Ti-rich precipitate formation and products whose ductility and shape memory behavior may be significantly impaired. Optimization of processing parameters in these prior processes may be able to reduce the magnitude of these effects, but must be performed on a part-by-part basis that makes such optimization unique to each specific application.

Certain work for NiTi-based SMAs has attempted to achieve drive-in diffusion from a gaseous phase by use of titanium as a vapor source. However, it has been discovered that titanium cannot achieve equilibrium with the desired product NiTi under typical process conditions. Specifically, below 942° C. titanium can only be in equilibrium with $Ti_2Ni$ in a binary Ni—Ti system. For this reason, target substrates in previous studies have been subject to over-titanization, resulted in undesired $Ti_2Ni$ formation, and ultimately exhibited degraded SMA performance.

It is an object of the present disclosure to utilize processes for the formation of SMAs with precisely controlled chemistries having the desired shape memory properties. In accordance with the present disclosure, chemical vapor transport annealing is performed using precise selection of reactants in order to control the thermodynamic chemical potential of species being transported. Aspects of the present disclosure permit the manufactured component to substantially equilibrate to a known and desired final composition state independent of process kinetics. The desired composition can therefore be imparted without having to optimize based on component geometry or process kinetics.

The process of the present disclosure involves the controlled addition of an alloying element to a metal alloy component workpiece, or the controlled removal of an element from the workpiece. For example, in one embodiment, Ti is added to a Ni—Ti component. This is accomplished by heterogeneous equilibration against a source of alloying element. One preferred embodiment involves transport of Ti from a Ni—Ti source to a Ni—Ti component. Other embodiments involve transport in the other direction (i.e., removal of an element from a component). Still other embodiments involve concurrent transport in both directions.

In one embodiment, the process of the present disclosure comprises heating a shaped metal component and an alloying element source of vapor-phase transportable alloying element species in a reactor under conditions which cause the vapor-phase transportable alloying element species to diffuse into the shaped metal component to thereby form a metal alloy component alloyed with element species from the alloying element source. In another embodiment, the process of the present disclosure comprises heating a shaped metal component and an alloying element sink for vapor-phase transportable alloying element species in a reactor under conditions which cause the vapor-phase transportable alloying element species to diffuse from the shaped metal component to the sink to thereby form a metal alloy component of a predetermined composition.

In carrying out the process of the present disclosure, a shaped metal component is acquired or fabricated. In one embodiment, the component comprises non-vapor-phase transportable species. That is, the shaped metal component comprises or consists essentially of species that are not vapor-phase transportable under the conditions which are used for vapor-phase transport of species into the component. The component is placed in a reactor along with a vapor source (or sink) that is specifically selected for the application so that the component will substantially equilibrate at the desired composition. In certain embodiments, a transport agent may be employed.

The reactor is heated to a suitable temperature to facilitate diffusive mass transport of the vapor-phase transportable species between the vapor source (or sink) and component. Reactor conditions are typically maintained until the system substantially attains equilibrium.

While the discussion herein may be directed to the formation of NiTi SMAs utilizing a shaped metal component comprising Ni and an alloying element source comprising Ti, it will be well understood by those skilled in the art that the processes described herein are equally applicable to the formation of SMAs comprising different shaped metal components and alloying element sources. The different shaped metal components and/or alloying element sources may be selected based upon their differential transport affinity, practical gas and solid-state transport kinetics, and/or the chemical potential of the transported species at the source or sink.

In the present method, titanium is transported to the nickel substrate, but nickel is generally not transported away from the substrate through the gas phase. These conditions prevent or limit the loss of fidelity of the substrate. In certain embodiments, alternative shaped metal components and/or alloying element sources may be selected to achieve similar reaction mechanics based on their differential transport affinity.

In embodiments comprising alternative shaped metal components and/or alloying element sources, it may be important to select these alternative metals or alloys based on the vapor phase solubility for the transported species. That is, the vapor phase solubility for the transported species must be high enough to facilitate adequate transport to/from the substrate through the gas phase as described herein. Additionally, upon contact with the reaction sites, the solid state diffusion kinetics of the materials must be adequate to react with the substrate and achieve a desired level of transport (i.e. thickness).

Still further, when utilizing alternative shaped metal components and/or alloying element sources, it may be important that the chemical potential of the transported species at the source or sink be controllable to attain the desired phase composition at the target substrate. That is, when utilizing a multi-phase vapor source (i.e. "multi-phase pack"), this pack must be designed such that the chemical potential is adequate to form the desired final product.

The present method improves upon existing reaction-based processing routes that are typically employed to synthesize NiTi via solid-state diffusion of titanium into a target substrate. In the present method, the target substrate (i.e. a shaped metal component) is instead equilibrated against constant chemical potential reservoirs designed to be in substantial equilibrium with NiTi (i.e. an alloying element source), thereby avoiding over-titanization and eliminating the need to optimize process kinetics to control elemental composition of the SMA component.

One benefit of the present process is the ability to preserve the architecture of the target substrate throughout the chemical conversion to the desired Ti-rich NiTi SMA composition. By separating the shape forming operation from the operation of controlling the chemistry of the final product, techniques that may have been previously employed to produce pure nickel or nickel-based substrates can now be used for the production of NiTi SMAs. In shape preserving reaction processing schemes, for example, stereolithography can be used to manufacture complex shaped templates (e.g., truss lattices or tensegrity structures), the templates can be coated to produce nickel shaped metal components, and finally the shaped metal components can be converted to a NiTi-based SMA using the methods described in further detail below comprising a vapor-phase transport agent. The process of coating the templates to produce shaped metal components may comprise any traditional process suitable for such coating. For example, electroplating or chemical vapor deposition of nickel onto fugitive templates to produce complex shaped nickel components.

Although the process as described herein for preparing a SMA may utilize a target substrate that is deficient in alloying element source content (i.e., a pure nickel shaped metal component deficient in titanium), the processes described herein can also be used to repair compositional deficiencies in SMA components produced by solidification processes such as selective laser melting or fusion welding.

The design of chemical vapor transport processes often concerns methods for establishing suitable chemical potential gradients to control rates and net directions of matter transport. For example, crystal growth experiments that employ sublimation and condensation establish chemical potential gradients mainly by use of zoned temperature differences. Alternatively, for an isothermal system, chemical potential gradients in the gaseous phase can be established by heterogeneous equilibria at reaction interfaces. At a fixed process temperature, chemical potential gradients in the gaseous phase are established by gas-solid interface reactions and regulated by the chemistry of the condensed phase(s) located at the vapor source and sink.

The method of the present disclosure generally comprises heating a shaped metal component and an alloying element source of vapor-phase transportable alloying element species in a reactor in the presence of a vapor-phase transport agent, wherein the heating is conducted under conditions which cause the vapor-phase transportable alloying element species to diffuse into the shaped metal component; and forming a metal alloy component alloyed with element species from the alloying element source.

In certain embodiments, it has been discovered that a method of the present disclosure produces improved results wherein the shaped metal component has a thickness of about 5 cm or less, about 4 cm or less, about 3 cm or less, about 2 cm or less, about 1 cm or less, about 9 mm or less, about 8 mm or less, about 7 mm or less, about 6 mm or less, about 5 mm or less, about 4 mm or less, about 3 mm or less, about 2 mm or less, about 1 mm or less, about 0.75 mm or less, about 0.5 mm or less, about 0.25 mm or less, or about 0.1 mm or less.

The reactor may comprise any suitable reactor. For example, in one embodiment, the reactor comprises a sealed quartz chamber. In various embodiments, the reactor may be dried at a temperature of about 800° C. or greater, about 850° C. or greater, about 900° C. or greater, about 950° C. or greater, or about 1000° C. or greater to remove moisture prior to introduction of the reaction components.

In certain embodiments, the heating of the shaped metal component and the alloying element source may take place at a temperature of about 600° C. or greater, about 650° C. or greater, about 700° C. or greater, about 750° C. or greater, about 800° C. or greater, about 850° C. or greater, about 900° C. or greater, about 950° C. or greater, or about 1000° C. or greater.

In some embodiments, the method comprises continuing the heating until the shaped metal component and the alloying element source substantially attain equilibrium. In other embodiments, the method comprises continuing the heating for about 1 hour or longer, about 2 hours or longer, about 4 hours or longer, about 6 hours or longer, about 8 hours or longer, about 10 hours or longer, or about 12 hours or longer.

In various embodiments, the heating step may comprise ramp rates of 5° C./min, followed by cooling ramp rate of 5° C./min at the conclusion of the heating step. In other embodiments, the ramp rate(s) may be selected from about 1° C./min, about 2° C./min, about 4° C./min, about 6° C./min, about 8° C./min, about 10° C./min, about 15° C./min, or about 20° C./min.

In certain embodiments, aspects of the present disclosure are directed to preparing a shape memory alloy utilizing a chemical vapor transport process comprising a shaped metal component, an alloying element source of a vapor-phase transportable alloying element species, and a vapor-phase transport agent. The reaction steps of this process may be illustrated, for example, as shown in FIG. 1. In FIG. 1, solid phases are shown in solid circles with arrows indicating phase transitions. Vapor phase species are depicted by dominant transport molecules between each step as determined by thermodynamic calculations. First, a halide vapor-phase transport agent (i.e. iodine) is released by thermal decomposition of nickel iodide. The released vapors I and $I_2$ subsequently establish a reactive atmosphere that facilitates the transport of the system components in three steps. In step 2, titanium is transported via the gaseous halide intermediates. In step 3, a gas-solid interface reaction occurs and results in a drive-in diffusion at the target substrate (i.e. sink). In step 4, iodine is returned to complete the transport cycle. As shown in FIG. 1, reaction steps 2-4 continue until the chemical potentials of the system components are equal at both the source (i.e., $NiTi+Ti_2Ni$) and the sink (i.e., shaped metal component).

For example, in one embodiment, a Ni-based shaped component and a two-phase $NiTi/NiTi_2$ vapor source along with nickel iodide as a source of transport agent are placed in a sealed quartz ampoule reactor. The reactor is heated to 900° C. and held there for four or more hours to allow the component composition to equilibrate. Titanium is selectively transported from the vapor source to the shaped component. Nickel has no measurable transport kinetics under these conditions. The shaped component geometry is preserved.

The process of the present disclosure may utilize a single-phase or two-phase vapor source. For example, an embodiment may utilize a Ti vapor source and Ni shaped metal component and equilibrate the shaped metal component to either the Ti-rich or Ni-rich solvus boundary of the NiTi homogeneity region. In one embodiment, the process may utilize a relatively pure alloying element source of vapor-phase transportable alloying element species such as titanium powder or titanium sponge. In another embodiment, the process may utilize a two-phase vapor source/sink. For example, NiTi+$NiTi_2$ or $TiNi_3$+NiTi. A two-phase vapor source (e.g., NiTi+$NiTi_2$ or $TiNi_3$+NiTi) may be referred to herein as a "two-phase pack."

In certain embodiments, the two-phase mixture may be prepared by a process comprising dry ball milling nickel flake and titanium powder with stabilized $ZrO_2$ media. Subsequently, the powders may be pressed into pellets at a pressure of about 5 MPa or greater, about 6 MPa or greater, about 7 MPa or greater, about 8 MPa or greater, about 9 MPa or greater, or about 10 MPa or greater. In various embodiments, the pellets may be subsequently subjected to homogenizing heat treatments in order to attain the desired phase composition.

In embodiments wherein the process comprises a two-phase vapor source comprising Ti and Ni, the two-phase mixture may have an overall molar ratio of Ti:Ni of from about 10:1 to about 1:10, from about 10:1 to about 1:8, from about 8:1 to about 1:8, from about 8:1 to about 1:6, from about 6:1 to about 1:6, from about 6:1 to about 1:5, from about 5:1 to about 1:5, from about 5:1 to about 1:4, from about 5:1 to about 1:3, from about 5:1 to about 1:2, from about 5:1 to about 1:1, from about 4:1 to about 1:1, from about 3:1 to about 1:1, or from about 3:1 to about 2:1. For example, the two-phase mixture may have an overall molar ratio of Ti:Ni of about 3:2.

For a two-component system, the Gibbs phase rule (i.e., F=C−P+2−I where F is degrees of freedom, C is the number of independent components, P is the number of phases, and I is the number of constrained intensive parameters such as temperature, pressure, or chemical potential) mandates that the chemical potential of Ti be fixed in a two-phase region. By fixing the chemical potential of Ti at the source, the equilibrium point for the shaped component is well defined and the reaction will only proceed until substantial equilibrium is reached. The solid-state phase transformation sequence Ni>$Ni_3Ti$>Ni-rich NiTi>Ti-rich NiTi is expected to occur first at the gas-solid interface and subsequently into the bulk of the target substrate as titanium drive-in diffusion proceeds. Since the maximum titanium chemical potential at the gas-solid interface is regulated by the two-phase NiTi+$Ti_2Ni$ pack, no additional drive-in diffusion of titanium is permissible once the surface attains a composition corresponding to Ti-rich NiTi and bulk transformation of the substrate to $Ti_2Ni$ is not thermodynamically feasible. This eliminates a need to optimize process kinetics.

For an isothermal, two-component system such as Ni—Ti, equilibrium is limited to the solvus boundaries. To equilibrate the system at compositions lying within the homogeneity region, two options are available: varying the temperature or altering the composition of the vapor source/sink. For example, the composition may be altered by use of an inert diluent such as Cu. Additional vapor phase transportable diluents such as Hf, Zr, V and others could be included in the vapor source to achieve more complex chemical compositions in the final shaped component.

Invariant systems (i.e., F=0) possess the advantageous feature that small perturbations from equilibrium may be remedied by varying the amount of phases present but not their compositions. For larger perturbations from equilibrium (e.g., corresponding to the initial state of the system comprising a two-phase NiTi+$Ti_2Ni$ pack and Ni as the surface phase at the target substrate gas-solid interface) transient states prevailing at gas-solid interfaces may affect matter transport and system pressures. If local equilibrium is attained at the gas-solid interface of the target substrate in an intermediate step in the solid-state phase transformation sequence such as $Ni_3Ti$, then fugacities and transport efficiencies can be calculated as discussed in further detail below and shown as in Table 1 and Table 2.

The process of the present disclosure utilizes vapor-phase transport agents to enhance transport rates in the form of gaseous intermediates. Halides are frequently selected as transport agents for transition metals. In the case of transport of titanium, iodine has been discovered to be a suitable halide transport agent. Titanium iodides have been found to exhibit favorable reactivities as compared to more thermodynamically noble fluorides and chlorides.

The gas phase solubility $\lambda_n$ of titanium in iodine is given by $\lambda_{Ti}=f^*_{Ti}/f^*_1$ where f is fugacity and f* denotes the balance fugacity. If the only stable gaseous species containing these components include Ti, I, $I_2$, TiI, $TiI_2$, $TiI_3$, and $TiI_4$, then the gas phase solubility of titanium in iodine can be computed as $\lambda_n=(f_{Ti}+f_{TiI}+f_{TiI2}+f_{TiI3}+fTiI_4)/(f_I-2f_{I2}+f_{TiI}+2f_{TiI2}+3_{TiI3}+4f_{TiI4})$. Equilibrium fugacities attained at gas-solid interfaces in accordance with the reaction sequence shown in FIG. 1 are set forth below in Table 1.

TABLE 1

| | Step | | | |
|---|---|---|---|---|
| | 1) Iodine release | 2) Titanium transport | 3a) Ni—Ti Interdiffusion | 3b) Ni—Ti Interdiffusion |
| | | Interface Reaction | | |
| | Ni + gas | $Ti_2Ni$ + NiTi + gas | $Ni_3Ti$ + gas | NiTi + gas |
| Species | | Fugacities [bar] | | |
| I | 2.69E−01 | 1.65E−04 | 5.00E−03 | 2.04E−04 |
| $I_2$ | 1.55E+00 | 5.80E−07 | 5.32E−04 | 8.84E−07 |
| Ni | 4.10E−12 | 1.00E−14 | 4.10E−12 | 2.05E−14 |
| NiI | 8.39E−05 | 1.25E−10 | 1.56E−06 | 3.17E−10 |
| Ti | — | 1.72E−14 | 4.33E−20 | 8.38E−15 |
| TiI | — | 1.64E−09 | 1.25E−13 | 9.88E−10 |
| $TiI_2$ | — | 4.65E−02 | 1.08E−04 | 3.46E−02 |
| $TiI_3$ | — | 1.39E−01 | 9.75E−03 | 1.28E−01 |
| $TiI_4$ | — | 1.05E−01 | 2.24E−01 | 1.20E−01 |
| total | 1.81E+00 | 2.91E−01 | 2.39E−01 | 2.82E−01 |
| Ti* | — | 2.91E−01 | 2.34E−01 | 2.82E−01 |
| Ni* | 8.39E−05 | 1.25E−10 | 1.56E−06 | 3.17E−10 |
| I* | 3.37E+00 | 9.32E−01 | 9.32E−01 | 9.32E−01 |

Table 1 reports fugacities at the following stages of the multi-step reaction sequence shown in FIG. 1 at 900° C.: 1) Decomposition of $NiI_2$ prior to reaction with any solids present in the system; 2) Equilibration of the species from step 1 with a $Ti_2Ni$+NiTi two-phase pack; 3a) Equilibration of the species from step 2 with $Ni_3Ti$ (intermediate product); and 3b) Equilibration of the species from step 2 with Ti-rich NiTi (equilibrium product). Species with asterisk represent balance fugacities for indicated components.

The gas phase solubilities for titanium and nickel in iodine above the two-phase NiTi+$Ti_2Ni$ pack are $\lambda_{Ti}$=0.31 and $\lambda_{Ni}$=1.34×$10^{-10}$. These values highlight the negligible gas phase solubility for nickel in iodine, indicating that nickel can be considered as non-participatory in chemical vapor transport processes. That is, despite the presence of a chemical potential gradient for nickel, negligible transport of nickel is expected to occur. In contrast to nickel, there is a thirteen order of magnitude increase in the concentration of gaseous species containing titanium in the presence of iodine as compared to without under these process conditions. Therefore, iodine serves as an effective and selective transport agent for titanium. This selectivity is also advantageous, as there is negligible loss of nickel from the target substrate to the gas phase due to reverse transport along its chemical potential gradient (i.e., in the direction opposite that for titanium), thereby helping to preserve substrate geometry.

The use of nickel iodide as the halide vapor-phase transport agent, for example in the NiTi process of FIG. 1 is further advantageous in that the equilibrium vapor pressure of nickel iodide does not exceed 1 bar until it reaches a temperature of 830° C., as compared to a normal sublimation temperature of 184° C. for molecular iodine. This difference in vaporization pressures, especially in the intermediate temperature regime, helps to reduce the likelihood of ampoule over-pressurization while heating to the process temperature of 900° C. and facilitates ampoule evacuation with negligible iodine loss.

The gaseous species responsible for net transport of titanium and iodine in the process of the present disclosure can be determined by calculating the transport efficiency. Normalized transport efficiency calculations based on the equilibrium fugacities of Table 1 indicate that $TiI_2$ is responsible for approximately 60% of net transport. Normalized vapor transport efficiencies for species bearing titanium and iodine are summarized in Table 2.

$TiI_2$ and $TiI_3$ are mainly responsible for net transport of titanium in step 2 of the transport cycle of FIG. 1, with negligible participation of Ti and TiI. $TiI_4$ is mainly responsible for net transport of iodine in step 4 of the transport cycle of FIG. 1, with minor contribution from I and negligible participation of $I_2$ and NiI.

TABLE 2

| | Transport Cycle | | | |
|---|---|---|---|---|
| | 3a) $Ti_2Ni$ + NiTi to $Ni_3Ti$ | | 3b) $Ti_2Ni$ + NiTi to NiTi | |
| Species | $\tilde{w}_{Ti}$ | $\tilde{w}_I$ | $\tilde{w}_{Ti}$ | $\tilde{w}_I$ |
| I | | 3.90E−02 | | 2.70E−03 |
| $I_2$ | | 4.29E−03 | | 2.12E−05 |
| Ni | | | | |
| NiI | | 1.26E−05 | | 1.34E−08 |
| Ti | 9.91E−14 | | 4.73E−13 | |
| TiI | 9.46E−09 | | 3.44E−08 | |
| $TiI_2$ | 2.68E−01 | | 5.99E−01 | |
| $TiI_3$ | 7.32E−01 | | 4.01E−01 | |
| $TiI_4$ | | 9.57E−01 | | 9.97E−01 |

Aspects of the present disclosure can be used to repair manufactured components in the sense of restoring or imparting a particular desired composition. One situation where this could be used is in the refurbishing of a used component for application in a more severe environment than for which it was originally manufactured. Another situation in which aspects of the present disclosure could be used for repair is in connection with manufacturing methods which change the composition of the material during manufacturing. For example, when the component manufacturing involves a degree of melting or vaporization, such as a process relying on laser energy to attach sequential alloy layers to additively manufacture a final shape. In such a process, the application of laser energy can change the composition of the component if the alloy has different components which volatilize at different rates in reaction to the application of laser energy. In such situations it can therefore be desirable to impart a precise alloy composition or to restore a precise alloy composition after manufacture of a specific component.

EXAMPLES

Several experiments were conducted for the conversion of a nickel foam shaped metal component to a NiTi metal alloy component using two different titanium vapor sources: commercially pure titanium sponge and an intimately mixed two-phase NiTi+$Ti_2Ni$ pack. All trials were conducted in fused silica ampoules (commercially available from Technical Glass Products, >99.99% $SiO_2$, OH<5 ppm) that had been thoroughly dried at 950-1000° C. prior to sealing to remove adsorbed moisture.

Example 1

In a first experiment, commercially pure titanium sponge was utilized in a vapor phase conversion trial of a nickel foam shaped metal component.

INCOFOAM® nickel foam (420 g $m^{-2}$ density, 590 μm pore size, 1.6 mm thick, commercially available from Novamet Specialty Products), anhydrous nickel iodide (99.9%, commercially available from Strem Chemicals), nickel flake (−325 mesh, 99.9%, commercially available from Atlantic Equipment Engineers), titanium powder (−325 mesh, 99.7%, commercially available from Atlantic Equipment Engineers), and titanium sponge (3-19 mm, 99.5%, commercially available from Sigma-Aldrich) were used as received.

The INCOFOAM® nickel foam (nominally 10×10×1.6 mm, 45 mg mass) was loaded in close proximity to, but avoiding physical contact with, 3 g of titanium sponge along with 60 mg anhydrous nickel iodide. After charging the ampoule, the open end of the tube was flame sealed in air with excess titanium sponge used as an in situ getter of oxygen, nitrogen, and moisture. Titanization was subsequently performed by annealing the ampoule in a horizontal orientation at 900° C. for four hours with heating and cooling ramp rates of 5° C./min. After annealing, the ampoules were opened by striking a score made along its diameter. Upon opening, the ampoules often displayed pyrophoric ignition of remnant titanium sponge (i.e., 50% ignition rate from eight independent trials). Recovered ampoule contents were immersed in methanol and subjected to ultrasonication, followed by additional rinsing with methanol to remove residual titanium iodides.

Example 2

In another experiment, an intimately mixed two-phase NiTi+$Ti_2Ni$ pack was utilized in a vapor phase conversion trial of a nickel foam shaped metal component.

NiTi+$Ti_2Ni$ packs with an overall molar ratio of Ti:Ni of 3:2 were prepared by dry ball milling nickel flake and titanium powder with stabilized $ZrO_2$ media for 24 h. The powders were pressed into pellets using a stainless steel die (1.0 cm diameter) at approximately 9 MPa. The resulting pellets were subsequently heated at 5° C. min.$^{-1}$ to 950° C. under ultra-high purity argon (99.999%, Airgas) which was additionally gettered by flowing over heated zirconium sponge in an oxygen purification furnace. The temperature was held for four hours and was then cooled to room temperature at approximately 5° C. min.$^{-1}$.

For trials using an intimately mixed NiTi+$Ti_2Ni$ pack vapor source, a modified procedure was employed wherein the ampoule was lined with NiTi foil (Johnson Matthey, 0.002±0.001" thickness) and annealed at 950° C. for four hours in a flowing oxygen-gettered argon atmosphere. This served to reduce the stiffness of the foil and train the foil to retain the shape of the tube to facilitate its loading and unloading from the ampoule.

In the shape-retained foil, a charge consisting of two NiTi+$Ti_2Ni$ vapor source pellets totaling 6.481g mass (i.e., an equivalent number of moles of titanium as compared to the ampoules using a sponge vapor source in Example 1) was placed, one on each side, of an INCOFOAM® nickel foam. Additional pieces of NiTi foil were pushed into the shape-retained foil to hold the vapor source pellets and foam pieces in place during handling and evacuation. The resulting assemblage contained within the shape-retained foil was then pushed into a one-end closed fused silica tube (nominally 10.50 mm ID×12.75 mm OD×200 mm length) along with 60 mg anhydrous nickel iodide granules. The tube was evacuated for one hour, reaching an ultimate pressure of less than 5 mtorr. The tube was then sealed under vacuum by heating with an oxypropane torch. Titanization was performed in the same manner as described in Example 1, and samples recovered upon striking the scored ampoules. No pyrophoric ignition was observed in any system using two-phase titanium NiTi+$Ti_2Ni$ vapor sources.

Example 3

Crystalline phase quantification of starting materials and reaction products of Example 1 and Example 2 were determined by X-ray diffractography (XRD, Bruker D-2 Phaser or Philips Panalytical MPD) 35° to 70° 2 θ (Cu K-α radiation) in increments of 0.03° 2 θ, with 2 second step durations.

XRD analyses of NiTi+$Ti_2Ni$ pack materials prepared in accordance with the procedures of Example 2 were conducted by mounting, polishing, and annealing the pack at 120° C. to relax any strain induced transformations that may have occurred during specimen preparation.

Figure 2A:
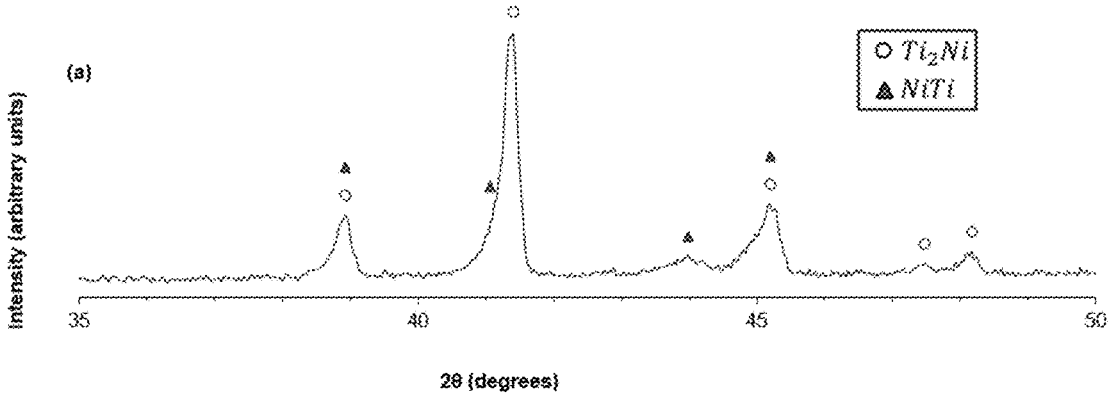
FIGS. 2A and 2B show the X-ray diffraction patterns of the reaction product upon equilibration of nickel foam components at 900° C. for four hours against pure titanium (FIG. 2A) and NiTi+$Ti_2Ni$ pack materials (FIG. 2B).
Figure 2B:
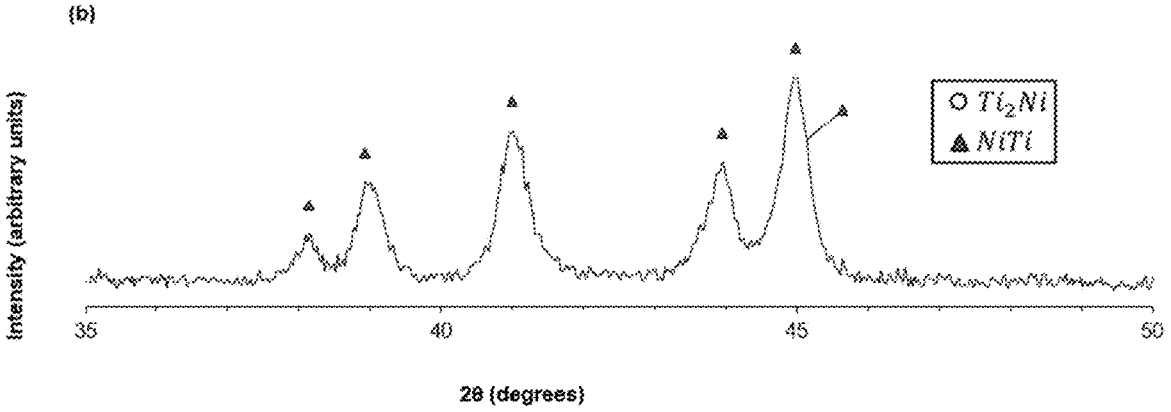

FIGS. 2A and 2B provide the X-ray diffraction patterns of the reaction product upon equilibration of nickel foam components at 900° C. for four hours against (a) pure titanium and (b) NiTi+$Ti_2Ni$ pack materials. As shown in FIGS. 2A and 2B, equilibration against pure titanium resulted in the formation of both $Ti_2Ni$ and NiTi products in the target substrate, whereas equilibration against a two-phase NiTi+$Ti_2Ni$ pack resulted only in NiTi formation.

Figure 3A:
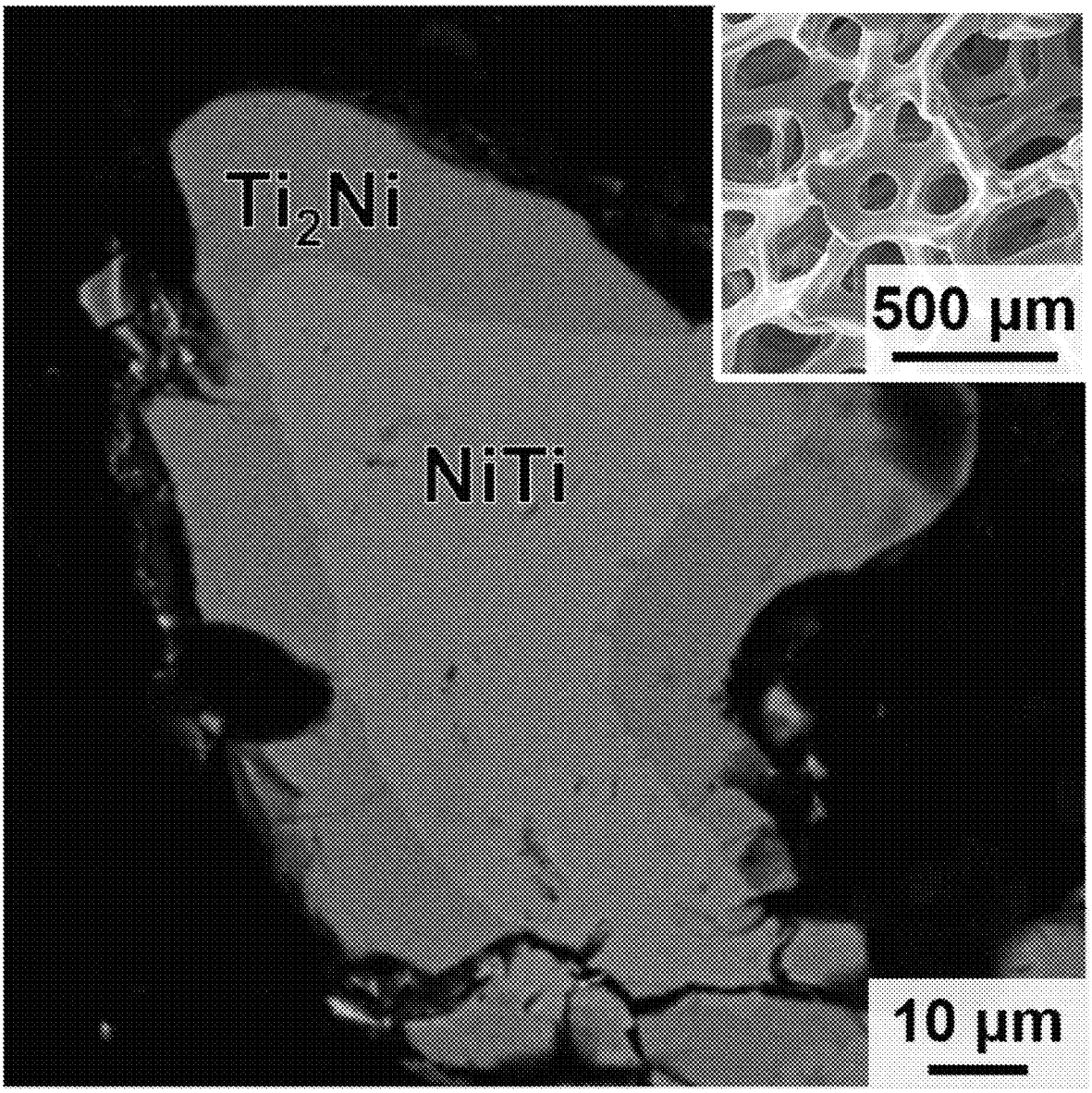
FIGS. 3A-3C show the backscatter scanning electron micrographs of reaction products upon equilibration of nickel foam specimens with pure titanium source (FIG. 3A) or two-phase NiTi+$Ti_2Ni$ (FIG. 3B).
Figure 3B:
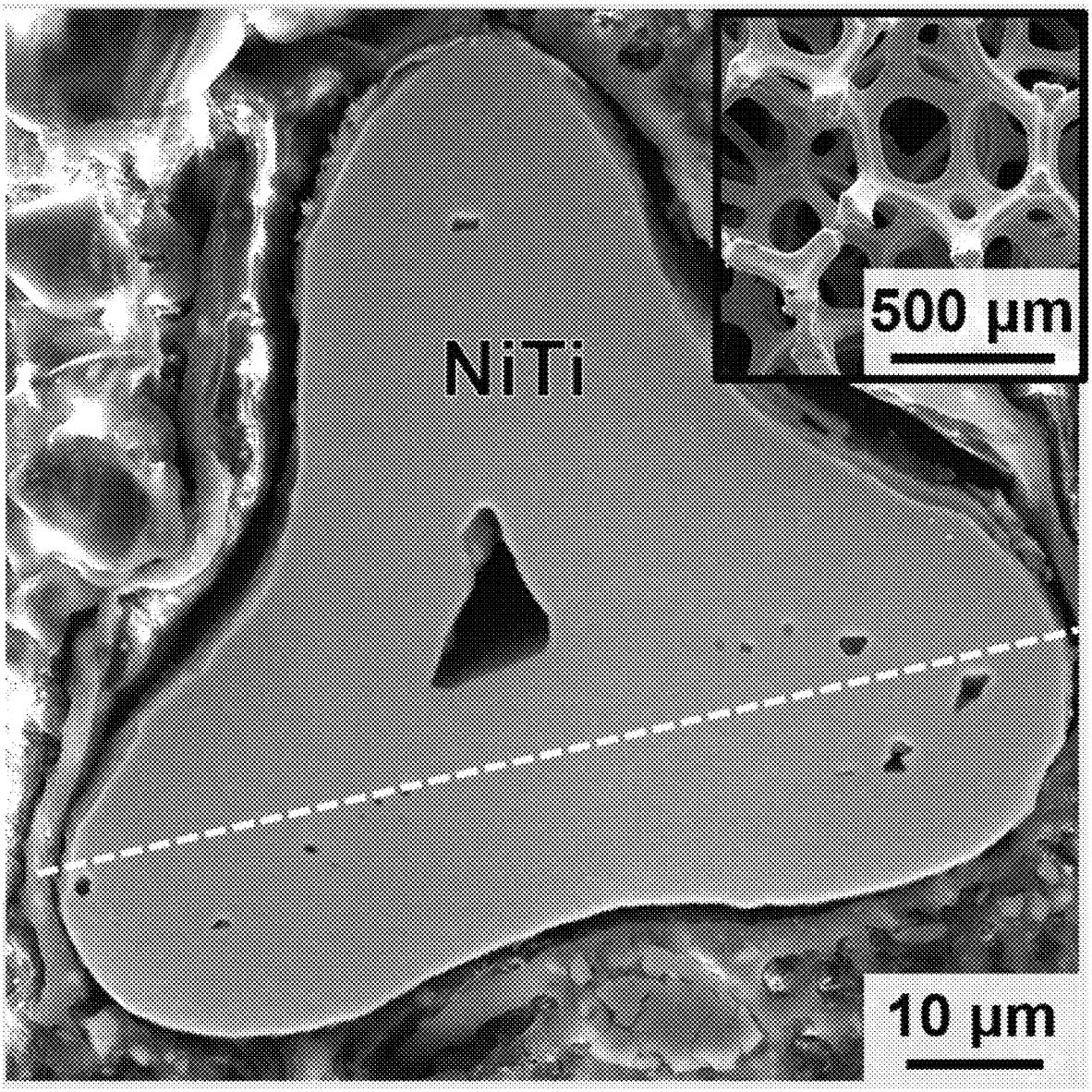
Figure 3C:
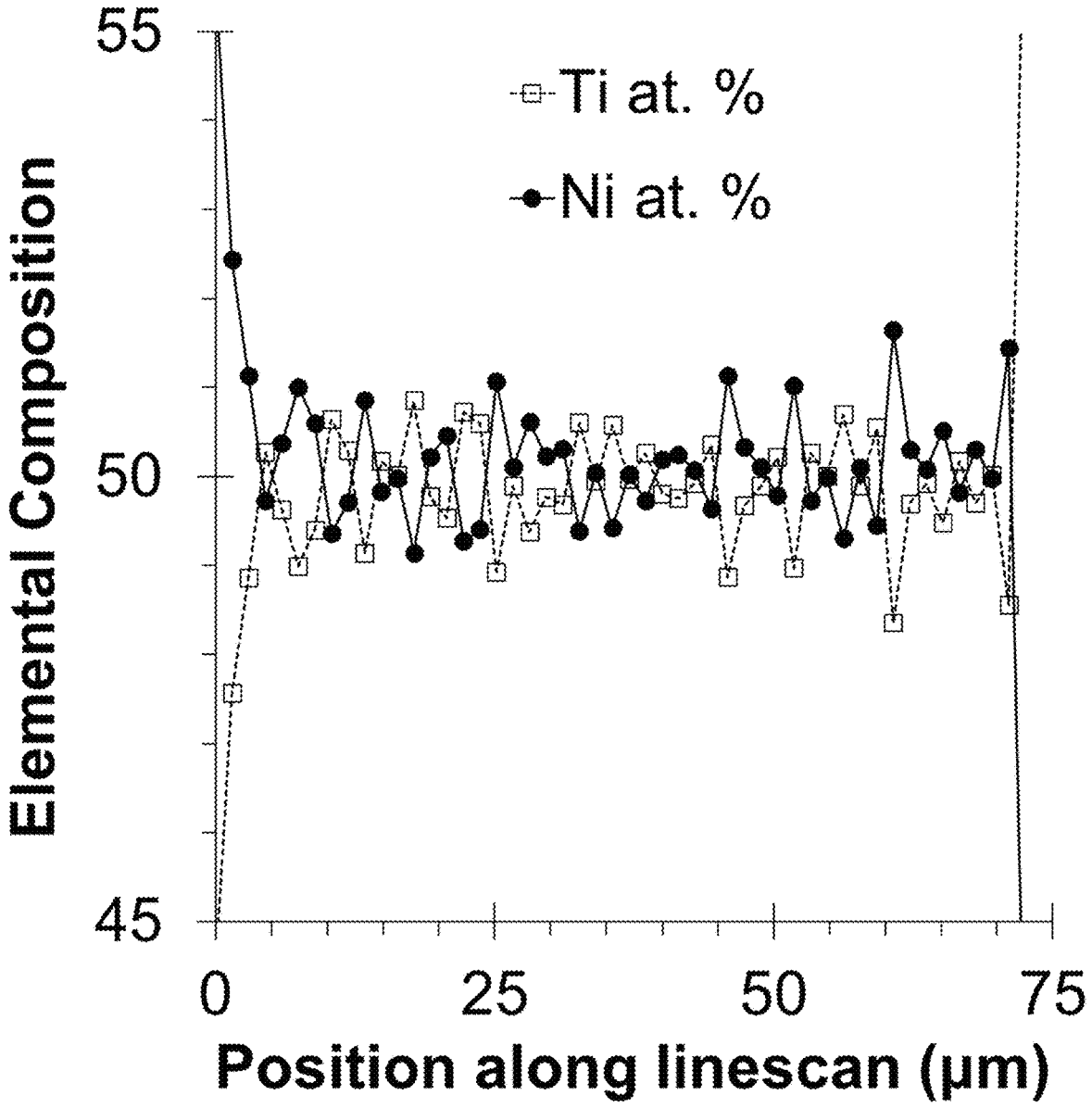

FIGS. 3A-3C shows backscatter scanning electron micrographs illustrating polished cross sections and low magnification images (insets) of reaction products upon equilibration of nickel foam specimens with (a) pure titanium source or (b) two-phase NiTi+$Ti_2Ni$ source at 900° C. for 4 hours. A representative EDS linescan across the dashed chord shown in FIG. 3B is given in FIG. 3C, indicating a near-equiatomic composition across the entire section. Calculated elemental compositions deviate at the ends of the specimen where signal from adjacent epoxy affects the standardless ZAF-corrected quantification procedure.

Over-titanization in the case of pure titanium was evidenced by measured gains in mass greater than would be expected for complete conversion of nickel to NiTi. Additionally, the presence of a $Ti_2Ni$ product layer observed via SEM/EDS in a polished cross-section of a foam strut as shown in FIG. 3A demonstrates over-titanization. Conversely, mass gains for the two-phase NiTi+$Ti_2Ni$ pack were consistent with complete conversion from nickel phase to pure NiTi, and no evidence of bulk $Ti_2Ni$ formation was observed via SEM/EDS analyses of polished cross-sections of foam struts, as highlighted in FIG. 3B and FIG. 3C.

Several trials featuring the two-phase NiTi+$Ti_2Ni$ pack were separately conducted for extended reaction times (i.e., 8 hours) with no detectable changes in the resultant products, indicating that net transport of titanium to the foam specimens had ceased within the original 4-hour processing. No other product phases or additional mass gains were evident, indicating that the employed reaction conditions were sufficient to fully react the target substrate without remnant nickel or nickel-rich intermediates, and that over-titanization can be prevented by use of an appropriate chemical potential regulated vapor source.

Example 4

Differential scanning calorimetry (DSC, TA Instruments QA 100) was used to verify and characterize the presence of martensitic-austenitic phase transformations of Example 1 and Example 2. Specimens were prepared by removing a 6.3 mm diameter disc and weighing approximately 25 mg of the reacted nickel foams. The foams were analyzed with a heat/cool/heat cycle at a heating rate of 10° C. min.$^{-1}$ to a maximum of 150° C. and cooling rate of 5° C. min.' to a minimum of −90° C. The initial heating segment of the cycle was excluded from the reported results because it included mechanical recovery from the preparation. Onset temperatures, temperature intervals, and specific latent heats of phase transformations in Ti-rich NiTi foams produced by the above method were measured via differential scanning calorimetry (DSC).

Figure 4A:
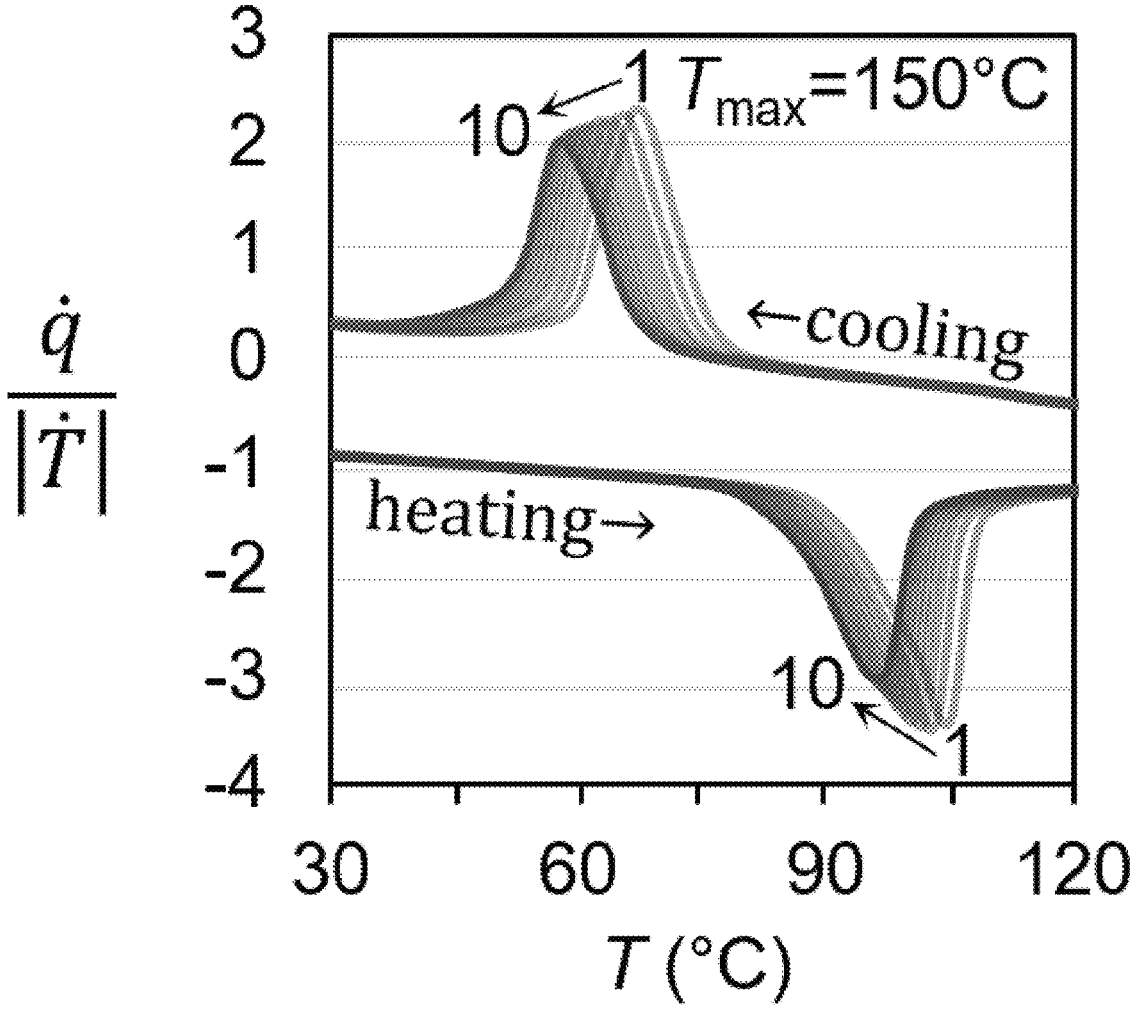
FIG. 4A illustrates phase transformation heat flows for ten consecutive heating and cooling cycles.

FIG. 4A illustrates phase transformation heat flows for ten consecutive heating and cooling cycles. A single-step reversible B2⇆B19' transformation was observed with no apparent intermediate R-phase through ten cycles. This figure indicates a reversible martensitic phase transformation.

Figure 4B:
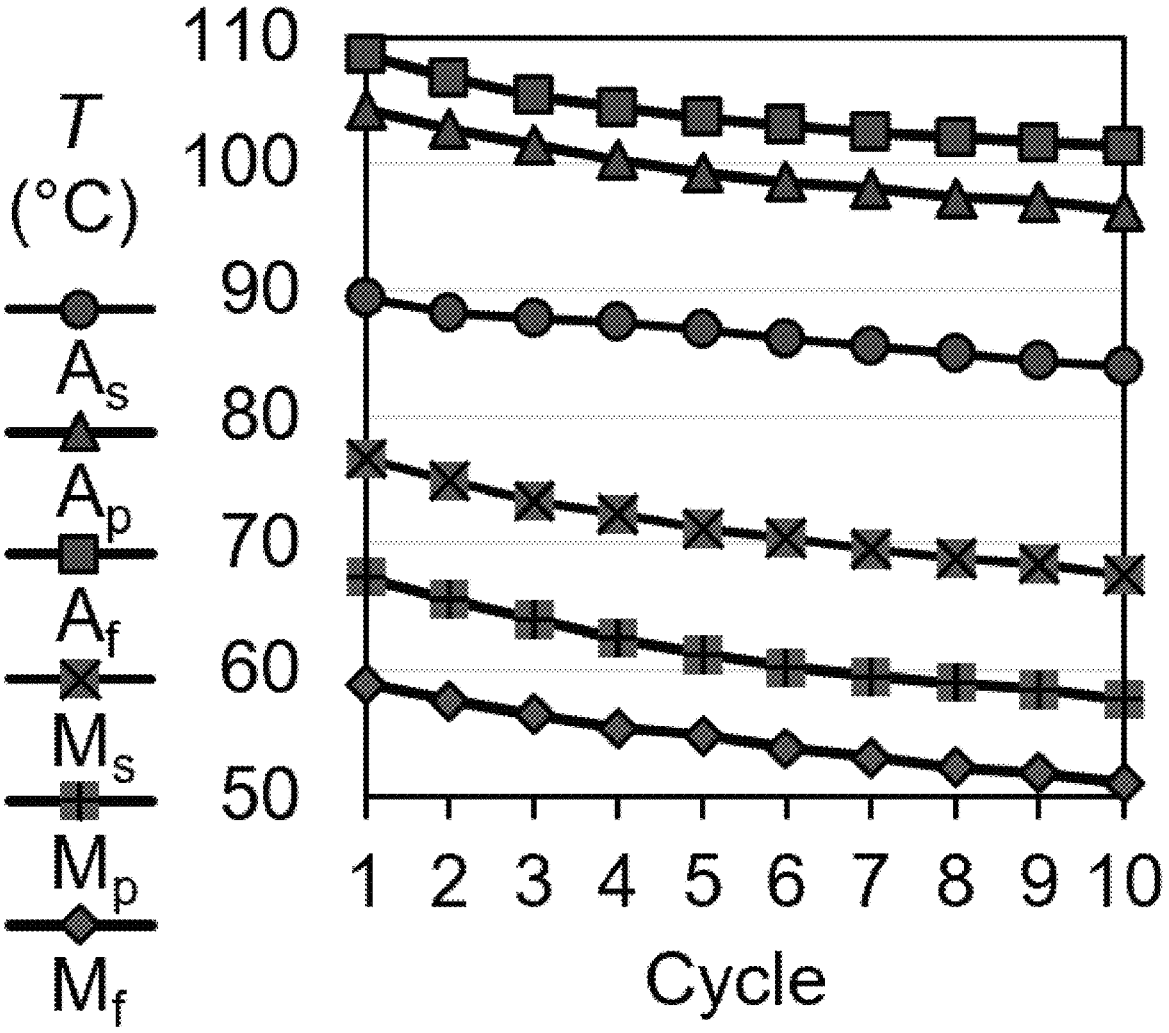
FIG. 4B reports the phase transformation temperatures observed in each thermal cycle.

FIG. 4B reports the phase transformation temperatures observed in each thermal cycle. The onset temperatures, calculated using the tangent method, were found to decrease monotonically with each thermal cycle. Temperature intervals $|M_s-M_f|$, $|A_s-A_f|$, $|M_s-A_f|$, and $|A_s-M_f|$ in the first through tenth cycles were found to be 17.8 to 16.4K, 19.3 to 17.5K, 32.0 to 33.9K, and 30.5 to 32.9K, respectively. The observed trends in onset temperatures and temperature intervals with increasing thermal cycles were consistent with the attribution of changes in phase transformation behavior to elastic strain energy effects from transformation-induced dislocation loops caused by repeated martensite interface movement.

Figure 4C:
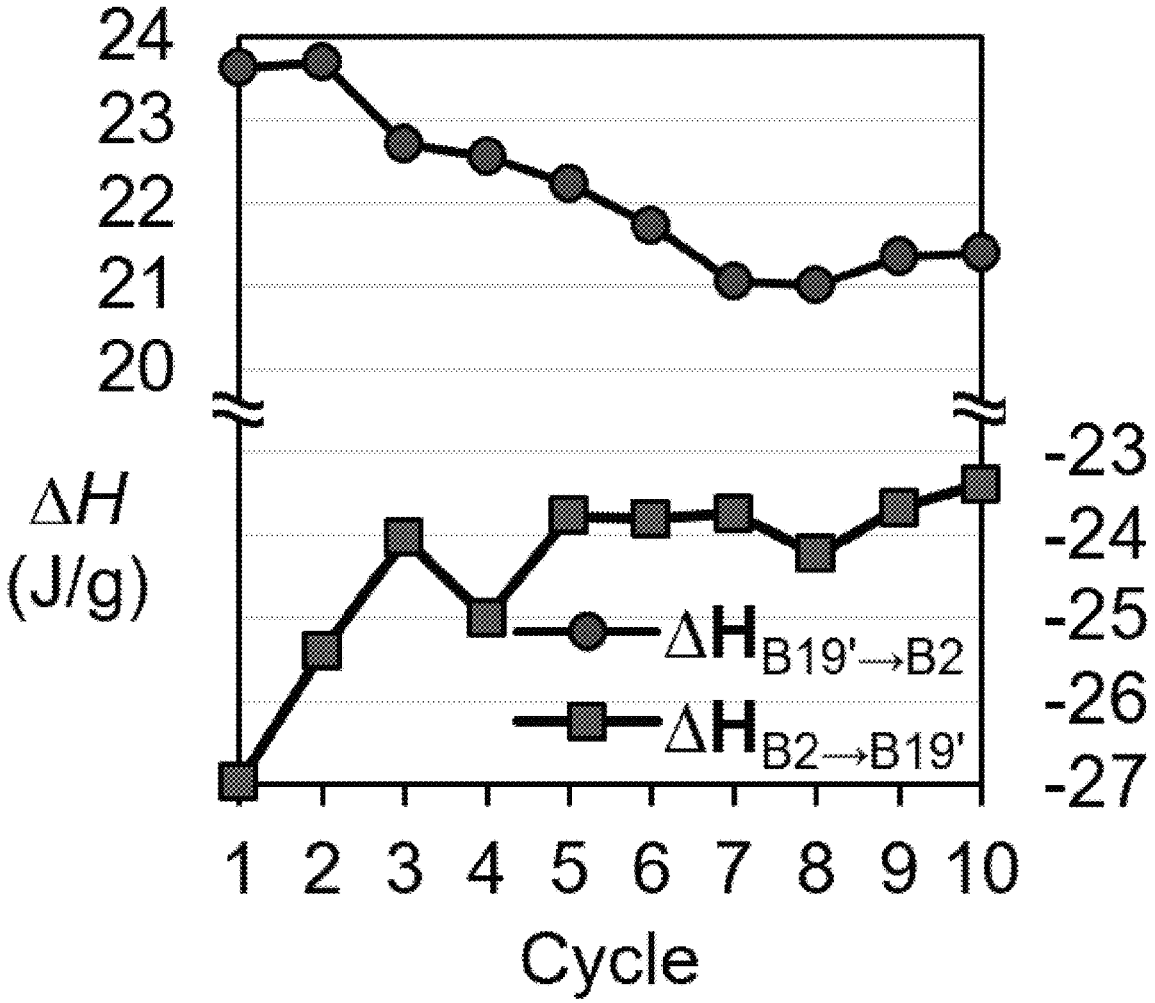
FIG. 4C illustrates the specific latent heats for phase transformations upon heating and cooling with each thermal cycle.

FIG. 4C illustrates the specific latent heats for phase transformations upon heating and cooling with each thermal cycle, as calculated by integration of heat flows above the baseline. Similar to the onset temperatures, the observed specific latent heats for phase transformations were generally consistent with those reported for Ti-rich NiTi, and indicate no major secondary phases are present that would diminish the transformation volume.

Example 5

Dynamic mechanical analysis (DMA, Instron 8874, 25kN load cell) was used to measure mechanical shape-memory response of the products of Example 1 and Example 2, using displacement-controlled compression at a displacement rate of 100 μm $s^{-1}$. One set of specimens were compressed to a minimum of 30% strain to determine where the onset of the twinning plateau occurred. This was repeated for two additional cycles, with a thermal recovery cycle between each compression cycle to examine the effects of strain on mechanical properties and shape-memory behavior. Using the high-strain data as a guide, incremental displacement-controlled strain plots were collected in 2% strain intervals until onset of the twinning plateau (14% strain) with a thermal recovery cycle between each compression cycle.

Figure 5A:
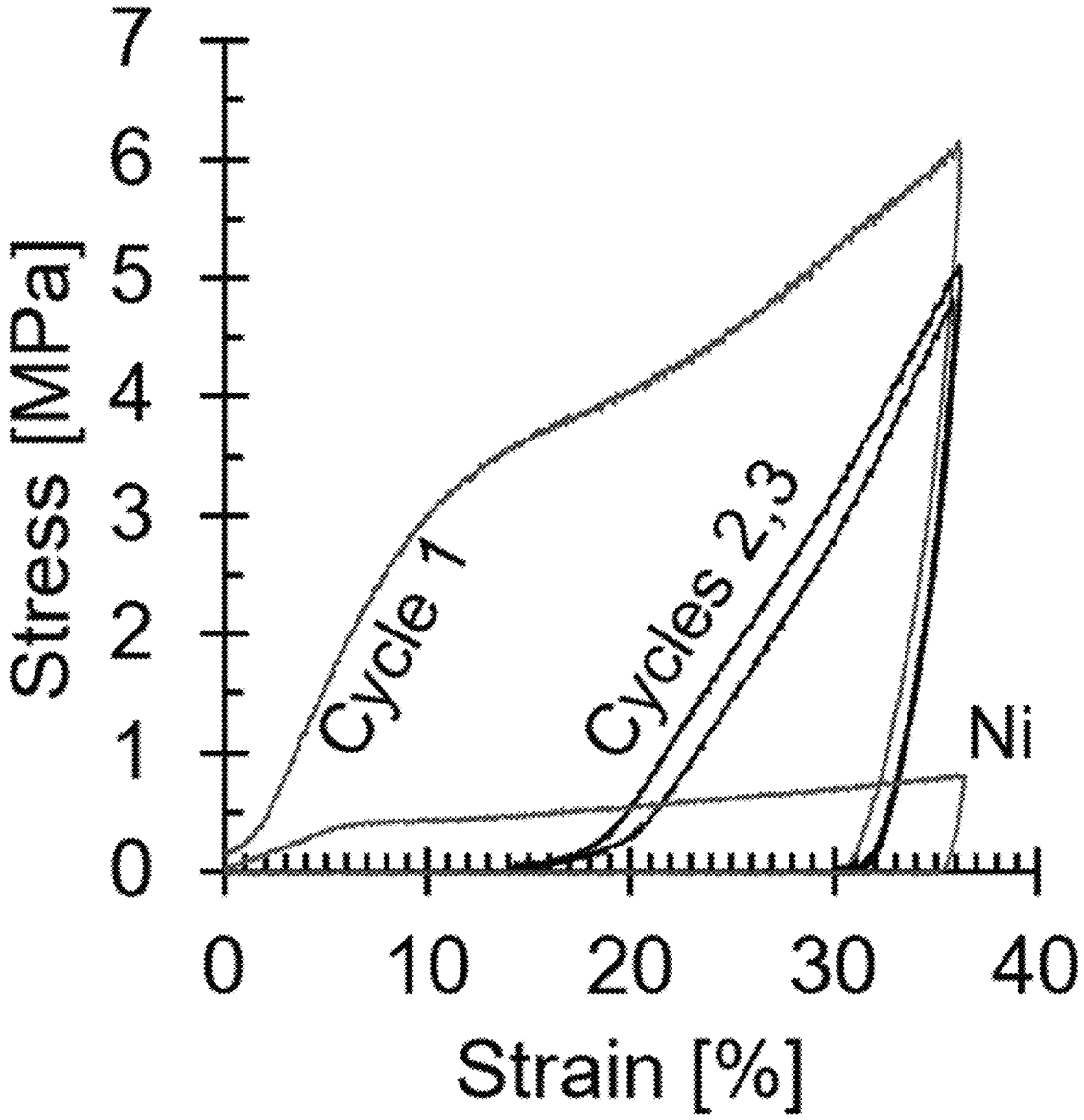
FIG. 5A shows the stress-strain curves of a produced Ti-rich NiTi foam for repeated incremental compressive strain loading with intermittent thermal recovery overlaid by a high-strain compressive loading curve.

FIG. 5A shows the stress-strain curves of the produced Ti-rich NiTi foam for repeated incremental compressive strain loading with intermittent thermal recovery overlaid by a high-strain compressive loading curve. Loading and unloading stiffnesses were found to be 36 MPa and 160 MPa, respectively, in the first loading cycle. The nearly fourfold increase in unloading stiffness relative to loading stiffness is believed to reflect significant detwinning during loading, which is absent during predominantly elastic relaxation that occurs upon initial unloading. The twinning plateau on loading began at about 14% compressive strain and thermal recovery in successive high-strain compressive cycles was consistently observed to be about 15%. Upon a second loading cycle, the foam showed modest reduction in loading stiffness from 36 to 27 MPa, though the unloading stiffness did not measurably vary. The magnitude of the unloading stiffness conformed to the predicted effective stiffness for a cellular solid in accordance with the following scaling law for open cell foams:

$$E = CE_s\left(\frac{\rho}{\rho_s}\right)^n \tag{1}$$

where E is Young's modulus of the cellular solid, C is a geometric constant on the order of 1 for ideal periodic cellular structures with dense cell walls, but generally is observed to lie in the range of 0.1-4.0 for real foams, $E_s$ is the Young's modulus of the corresponding dense solid, $$\frac{\rho}{\rho_s}$$

is the relative density, and n is an exponent typically in the range of 1.8-2.2.

For the NiTi foam, using n≈2, E=160 MPa (measured on unloading), $E_{S(NiTi)}$=68 GPa, and inputting a measured relative density of 5.80%, results in a C≈0.70. A similar calculation for the precursor nickel foam, using values of E=106.5 MPa (measured on unloading), $E_{s(Ni)}$=190 GPa, and measured relative density of 2.95%, results in a C≈0.65. This close agreement between the stiffness scaling law C values for the precursor nickel and NiTi foams indicated the similarity of microstructures preserved in the product of the process of the present disclosure. The C values being less than one is believed to reflect the material fractions bearing lesser loads than predicted by pure geometric modeling, which may indicate defects such as porosity or ruptured strut ligaments present in the nickel and NiTi metal alloy components.

Figure 5B:
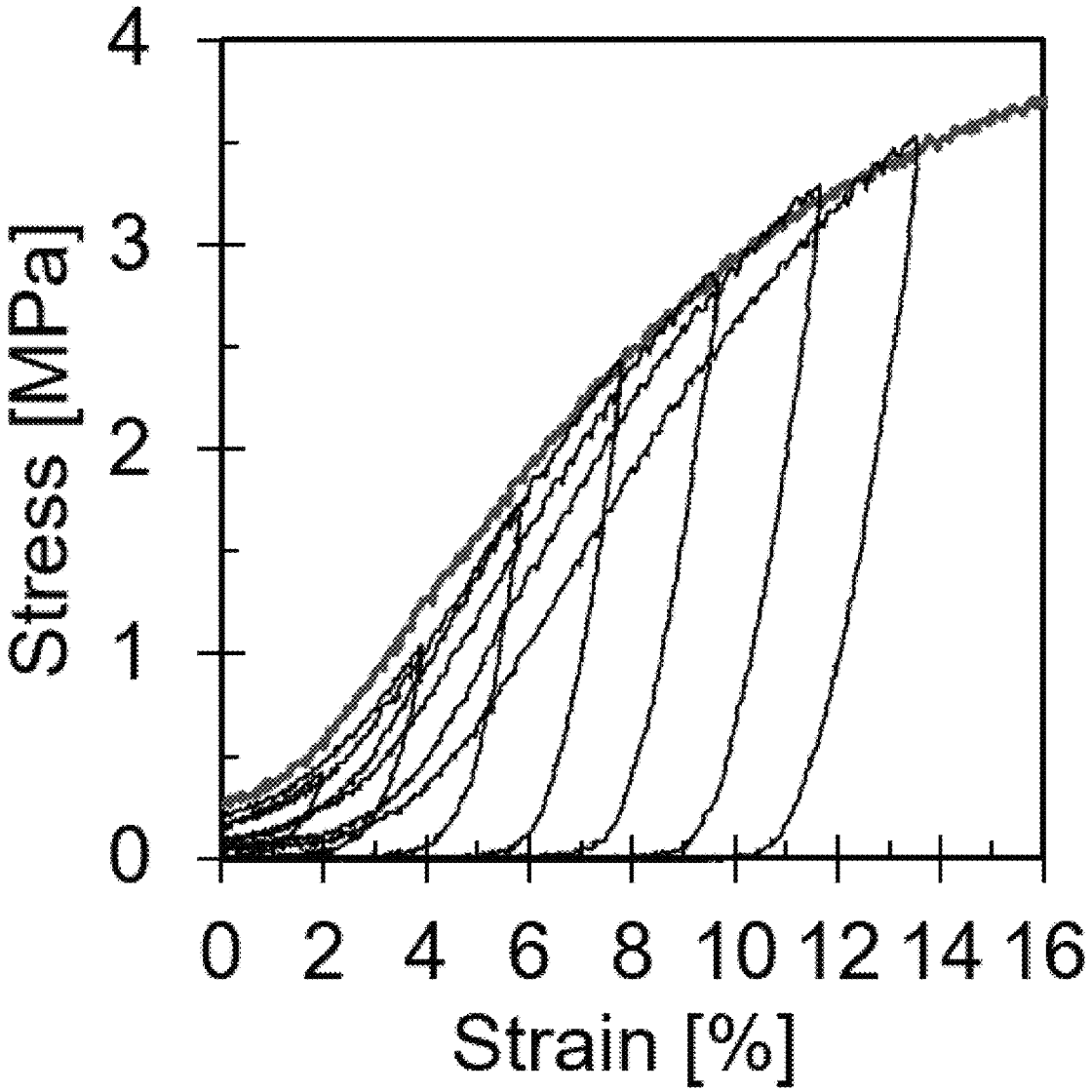
FIG. 5B shows stress-strain plots for displacement-controlled compressive cycles with intermittent thermal recovery between cycles of increasing incremental strain.
Figure 5C:
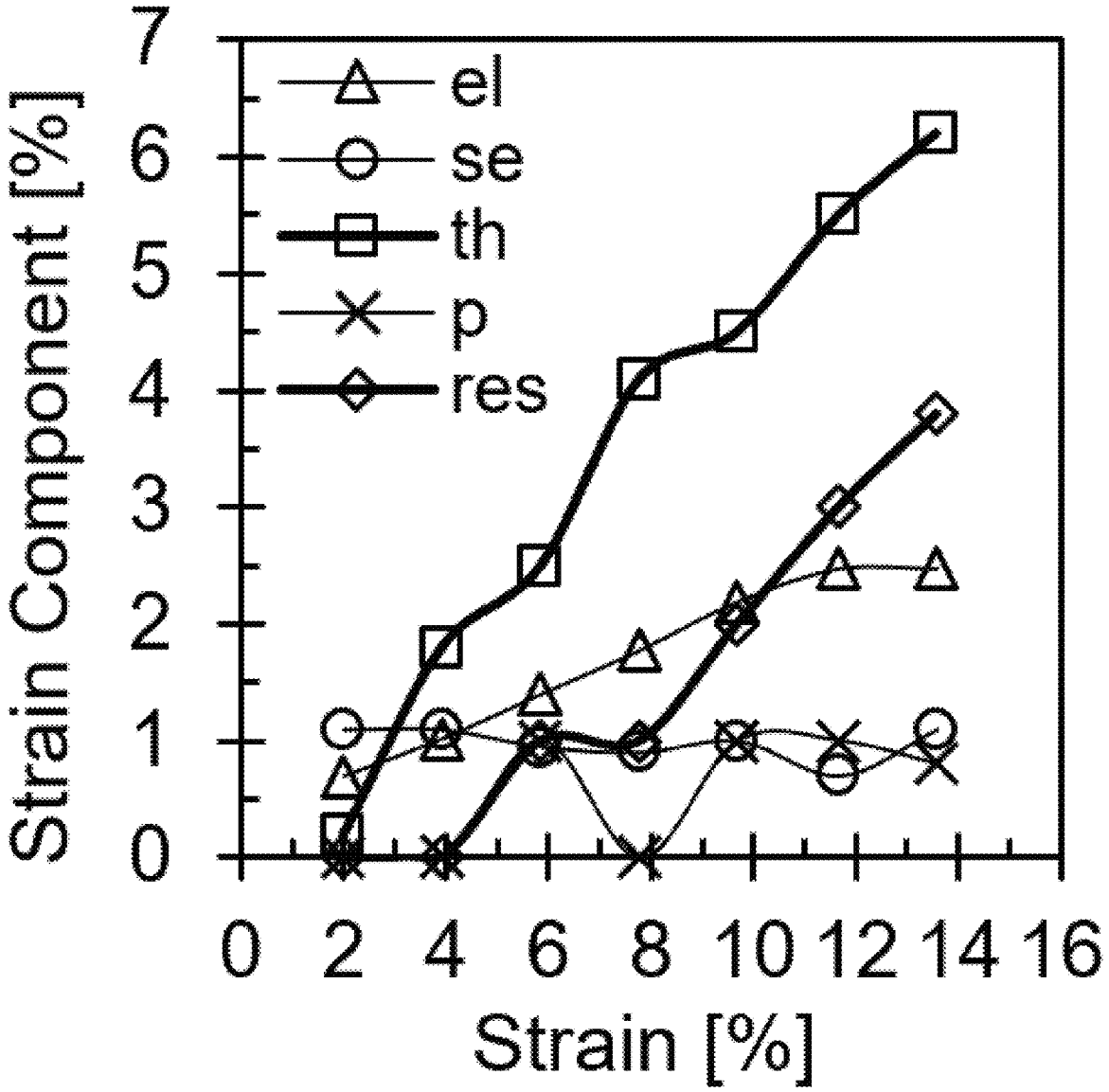
FIG. 5C shows strain components in relation to maximum applied strain in each loading cycle.

FIG. 5B shows stress-strain plots for displacement-controlled compressive cycles with intermittent thermal recovery between cycles of increasing incremental strain. Overlaid on the plot is a monotonic high-strain compression curve for the same specimen, whose close correspondence with the incremental strain curves illustrates the extent of shape memory recovery with each cycle. FIG. 5C shows strain components in relation to maximum applied strain in each loading cycle using the following nomenclature: "el"—elastic strain, "se"—super elastic strain, "th"—thermal recovery strain, "p"—plastic strain, and "res"—residual strain. The observed thermal recovery strain is less than half of the maximum applied strain in each cycle, with a consistent portion of superelastic recovery of ~1% strain, and a steadily increasing elastic recovery component ranging from 2% to 12%. At the maximum incremental strain of 15%, approximately 6% thermal strain was observed.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and processes without departing from the scope of the invention, it is intended that all matter contained in the above description and shown in the accompanying drawings shall be interpreted as illustrative and not in a limiting sense.

The invention claimed is:

1. A method for manufacturing a Ni—Ti metal alloy component comprising:

providing an alloying element source of vapor-phase transportable alloying element species and a shaped metal component;

heating the shaped metal component and the alloying element source in a reactor, wherein the heating is conducted under conditions which cause the vapor-phase transportable alloying element species to diffuse into the shaped metal component; and forming a metal alloy component alloyed with the element species from the alloying element source;

wherein the alloying element source is a two-phase alloying element source comprising a mixture of NiTi and $NiTi_2$ or NiTi and $TiNi_3$.

2. The method of claim 1, comprising continuing said heating until the shaped metal component and the alloying element source substantially attain thermodynamic equilibrium.

3. The method of claim 1, wherein the shaped metal component comprises a metal foam.

4. The method of claim 3, wherein the shaped metal component comprises a nickel foam.

5. The method of claim 1, wherein the shaped metal component comprises Ni.

6. The method of claim 1, wherein the mixture has an overall molar ratio of Ti:Ni of from about 10:1 to about 1:10.

7. The method of claim 1, wherein the method further comprises a transport agent comprising a halide.

8. The method of claim 7, wherein the halide is selected from the group consisting of fluoride, chloride, iodide, and mixtures thereof.

9. The method of claim 7, wherein the method further comprises a transport agent comprising iodide.

10. The method of claim 9, wherein the method further comprises a transport agent comprising nickel iodide.

11. The method of claim 1, wherein the shaped metal component has a thickness of about 5 cm or less.

12. A method for manufacturing a Ni—Ti metal alloy component comprising:

providing an alloying element source of vapor-phase transportable alloying element species and a shaped metal component;

heating the shaped metal component and the alloying element source in a reactor, wherein the heating is conducted under conditions which cause the vapor-phase transportable alloying element species to diffuse into the shaped metal component; and forming a metal alloy component alloyed with element species from the alloying element source;

wherein the alloying element source comprises a mixture of NiTi and $NiTi_2$ or NiTi and $TiNi_3$;

wherein the reactor comprises a sealed quartz chamber.

13. A method for manufacturing a Ni—Ti metal alloy component comprising:

providing an alloying element sink for vapor-phase transportable alloying element species and a shaped metal component;

heating the shaped metal component and the alloying element sink in a reactor under conditions which cause the vapor-phase transportable alloying element species to diffuse from the shaped metal component to the sink to thereby form a metal alloy component of a predetermined composition;

wherein the alloying element sink is a two-phase alloying element sink comprising a mixture of NiTi and $NiTi_2$ or NiTi and $TiNi_3$.

* * * * *